US009955847B2

(12) United States Patent
Tempelmann

(10) Patent No.: US 9,955,847 B2
(45) Date of Patent: May 1, 2018

(54) DISHWASHER

(71) Applicant: Electrolux Home Products Corporation, N.V., Brussels (BE)

(72) Inventor: Sarah Tempelmann, Stockholm (SE)

(73) Assignee: Electrolux Home Products Corporation, N.V., Brussels (BE)

( * ) Notice: Subject to any disclaimer, the term of this patent is extended or adjusted under 35 U.S.C. 154(b) by 0 days. days.

(21) Appl. No.: 15/058,855

(22) Filed: Mar. 2, 2016

(65) Prior Publication Data

US 2016/0198929 A1 Jul. 14, 2016

Related U.S. Application Data

(63) Continuation of application No. 13/121,510, filed as application No. PCT/EP2009/007408 on Oct. 15, 2009, now abandoned.

(30) Foreign Application Priority Data

Oct. 23, 2008 (EP) ..... 08018545

(51) Int. Cl.
*A47L 15/42* (2006.01)
*A47L 15/14* (2006.01)

(52) U.S. Cl.
CPC ..... *A47L 15/4208* (2013.01); *A47L 15/14* (2013.01); *A47L 15/4204* (2013.01);
(Continued)

(58) Field of Classification Search
CPC ..... A47L 15/4202; A47L 15/4204; A47L 15/4206; A47L 15/4208; B01D 2321/02;
(Continued)

(56) References Cited

U.S. PATENT DOCUMENTS 2,750,950 A * 6/1956 Inman ..... A47L 15/10 134/102.1
3,491,780 A 1/1970 Kaldenberg
(Continued)

FOREIGN PATENT DOCUMENTS

DE 89 13 614 U1 1/1990
DE 92 04 727 U1 6/1992
(Continued)

OTHER PUBLICATIONS

International Search Report for Application No. PCT/EP2009/007408 dated Feb. 5, 2010.
(Continued)

*Primary Examiner* — Marc Lorenzi
(74) *Attorney, Agent, or Firm* — Alston & Bird LLP

(57) ABSTRACT

Provided herein are a dishwasher comprising a washing chamber arranged for holding soiled items to be washed, a filter, and a circulation pump, and methods of operating the same. The washing chamber may be arranged such that, when the flow of washing liquid passes through the washing chamber, soil is released from the items to be washed and caught in the flow. The filter may be such arranged that, when the flow of washing liquid with soil passes through the filter, soil is separated from the flow of washing liquid and caught at the filter. The dishwasher may further include a soil trap, which is located separate from the circulation flow, and a soil removing unit including a transport unit for transport of the soil caught at the filter into the soil trap.

25 Claims, 6 Drawing Sheets

(52) U.S. Cl.
CPC ..... *A47L 15/4223* (2013.01); *A47L 15/4244* (2013.01); *A47L 2401/34* (2013.01); *A47L 2501/02* (2013.01)

(58) Field of Classification Search
CPC ..... B01D 2321/18; B01D 2321/185; B01D 2321/30
See application file for complete search history.

(56) References Cited

U.S. PATENT DOCUMENTS

| | | | | |
|---|---|---|---|---|
| 3,954,116 | A | 5/1976 | Guth et al. | |
| 4,972,861 | A | 11/1990 | Milocco et al. | |
| 6,303,035 | B1 * | 10/2001 | Cote | B01D 61/18 134/10 |
| 7,467,636 | B2 | 12/2008 | Welch | |
| 2004/0226581 | A1 | 11/2004 | Gardner et al. | |
| 2006/0237049 | A1 | 10/2006 | Weaver et al. | |

FOREIGN PATENT DOCUMENTS

| | | | | |
|---|---|---|---|---|
| DE | 42 00 416 | A1 | 7/1993 | |
| EP | 0 068 974 | A1 | 1/1983 | |
| EP | 0 963 732 | A1 | 12/1999 | |
| FR | 2 378 493 | | 8/1978 | |
| GB | 2 204 482 | A | 11/1988 | |
| GB | 2 254 542 | A | 10/1992 | |
| WO | WO 2009087750 | A1 * | 7/2009 | B01D 41/04 |

OTHER PUBLICATIONS

Written Opinion from International Application No. PCT/EP2009/007408 dated Feb. 5, 2010.
Extended European Search Report from European Application No. 08018545.7 dated Jan. 27, 2009.
Communication Pursuant to Article 94(3) EPC from European Application No. 08 018 545.7 dated May 2, 2012.
Office Action for U.S. Appl. No. 13/121,510 dated Aug. 5, 2014.
Office Action for U.S. Appl. No. 13/121,510 dated Nov. 14, 2014.
Office Action for U.S. Appl. No. 13/121,510 dated Jul. 22, 2015.
Office Action for U.S. Appl. No. 13/121,510 dated Nov. 2, 2015.

* cited by examiner

DISHWASHER

CROSS REFERENCE TO RELATED APPLICATIONS

This application is a continuation of U.S. application Ser. No. 13/121,510, filed Jun. 10, 2011, which application is a national stage application filed under 35 U.S.C. 371 of International Application No. PCT/EP2009/007408, filed Oct. 15, 2009, which claims priority from European Application No. 08018545.7, filed Oct. 23, 2008, each of which is incorporated by reference herein in its entirety.

TECHNICAL FIELD OF THE INVENTION

The present invention relates to a dishwasher comprising a washing chamber arranged for holding soiled items to be washed, a filter and a circulation pump. The circulation pump is operable to create a circulation flow of washing liquid through the washing chamber, through the filter and back to the washing chamber. The washing chamber is such arranged that, when the flow of washing liquid passes through the washing chamber, soil is released from the items to be washed and caught in the flow. The filter is such arranged that, when the flow of washing liquid with soil passes through the filter, soil is separated from the flow of washing liquid and caught at the filter.

BACKGROUND ART

A problem with dishwashers of the above mentioned type is that the filter has a tendency to clog by soil particles that are caught at the filter. Therefore, conventional dishwashers are normally equipped with two filters, i.e. a fine-mesh filter and a coarse-mesh filter. The circulation flow is then divided between the two filters, wherein most of the flow passes through the coarse-mesh filter and the rest of the flow passes through the fine-mesh filter. Thereby, the major part of the larger soil particles will be caught at the coarse-mesh filter. The finer particles will only be caught at the fine-mesh filter, some instantly and some after passing through the coarse-mesh filter and passing through recirculation. Thus, this arrangement reduces the load on the fine-mesh filter.

However, also in these types of conventional dishwashers the filter might clog during the dishwashing. To achieve a desired washing result, the filter may need to be cleaned, which is cumbersome for the user.

Dishwashers equipped with a filter cleaning function have previously been designed. One example of filter cleaning is flushing of water through the filter in a direction opposite to the circulation direction. Filter clogging could however still be a problem.

SUMMARY OF THE INVENTION

It is therefore an object of the present invention to provide a dishwasher that alleviates at least some of the above mentioned problems.

This object is achieved by a dishwasher having the features defined in the appended claim 1. Preferred embodiments thereof are defined in the dependent claims 2-15.

Thus, the invention is based on the insight that it would be advantageous to remove soil from the circulation flow, preferably as quickly as possible. Due to the arrangement of a soil removing unit and a soil trap according to the present invention, soil is removed from the filter, and a soil trap, located separate from the circulation flow, can store the soil particles separate from the circulation flow. The risk of clogging the filter can thus be reduced. Furthermore, with reference to prior art dishwashers described above having a coarse-mesh filter and fine-mesh filter, wherein larger soil particles are caught at the coarse-mesh filter and there stored in the circulation flow, the present invention solves the problem of such larger particles continuously generating smaller soil particles that recirculate with the circulation flow. Thus, a dishwasher according to the present invention provides a more efficient filter system.

According to one aspect of the invention, there is provided a dishwasher comprising a washing chamber arranged for holding soiled items to be washed, a filter and a circulation pump. The circulation pump is operable to create a circulation flow of washing liquid through the washing chamber, through the filter and back to the washing chamber. The washing chamber is such arranged that, when the flow of washing liquid passes through the washing chamber, soil is released from the items to be washed and caught in the flow. The filter is such arranged that, when the flow of washing liquid with soil passes through the filter, soil is separated from the flow of washing liquid and caught at the filter. The dishwasher further comprises a soil trap, which is located separate from the circulation flow, and a soil removing unit comprising a transport unit for transport of the soil caught at the filter into the soil trap.

The soil on the items to be washed is usually food scraps but can be any other substance the user wishes to wash off. The washing liquid is typically water with resolved dishwasher detergents but can be any other washing liquid.

The soil removing unit of the present invention comprises a transport unit, arranged to transport the soil caught at the filter to the soil trap. The transport unit can be arranged to push or draw soil caught at the filter surface over the filter surface and into the soil trap. The transport unit can be arranged to push the soil by flushing a fluid substantially parallel to the filter surface towards the soil trap. The fluid can for example be the washing liquid, fresh water or a combination thereof. The fluid will follow the soil into the soil trap. Nozzles can be arranged at the periphery of the filter, directed towards the inlet of the soil trap. The transport unit can alternatively be arranged as a mechanical scraper.

The soil removing unit can further comprise a filter cleaning unit, arranged to release soil from the filter such that it is more easily caught by the transport unit. The filter cleaning unit can be arranged to force fluid through the filter in a direction opposite to the circulation flow direction for releasing soil. The fluid can for example be the washing liquid, fresh water or combinations thereof.

Additionally or alternatively, the filter cleaning unit can be arranged to provide air or gas bubbles through the filter. The main part of the filter is then preferably located below the washing liquid level in the dishwasher and the filter cleaning unit comprises air or gas outlets arranged for providing bubbles through the filter in a direction opposite the direction of the circulation flow. Bubbles through the filter are advantageous also due to that the bubbles initiate vibrations to the filter, which will loosen soil from the filter.

The filter cleaning unit can alternatively or in addition to the bubbles comprise other vibration means for loosening of soil particles, for example biased, such as spring loaded agitating devices or devices imparting oscillating forces to the filter.

The soil removing can be performed continuously, pulsed or at predetermined intervals. To indicate the need for soil removal, a pressure sensor can for example be arranged in the dishwasher, for example at the circulation pump, to indicate a pressure build up due to filter clogging, whereby soil removal can be initiated. The soil removing unit can also be activated at predetermined intervals. Preferably, the filter cleaning unit is activated just before the transport unit, whereby soil particles are first loosened from the filter and then transported to the soil trap.

The soil trap is preferably located separate from the circulation flow of washing liquid, whereby the circulation flow is not guided into the soil trap. Instead, the circulation flow is guided to the circulation pump via a sump. The sump is a container at the bottom of the dishwasher, which container is connected to the circulation pump and to the drain of the dishwasher. The sump is arranged below a glass trap, which is a very coarse filter arranged to protect the circulation pump from large particles like tooth picks or pieces of broken glass. The soil trap can preferably be a liquid-tight container for collecting the soil. The inlet of the soil trap can preferably be located at a position above a washing liquid level of the dishwasher. This is to let the soil fall by gravitation into the soil trap without tendency to float out of it. The inlet of the soil trap placed above the washing liquid level does further prevent the circulation flow from entering the soil trap. The circulation flow can then be recirculated via the sump, without any need of refill of washing liquid. Alternatively, if the flow of washing liquid into the soil trap results in a lowered washing liquid level in the sump, the washing liquid can be refilled to keep a desired washing liquid level. The outlet of the soil trap is connected to the drain of the dishwasher.

The circulation flow refers to the main part of the washing liquid, which is circulated by the circulation pump. In an alternative embodiment, the soil trap is a permeable or a semi-permeable container arranged separate from the circulation flow, for example a fine-mesh container. The fluid of the transport unit, which has followed the soil into the soil trap, can then leak out through the wall of the soil trap and be conveyed into the sump. This is advantageous in that the liquid level in the soil trap would be self regulating at a low level. However, in such embodiments of the invention, there is a minor, auxiliary circulation flow through the soil trap.

The washing liquid level in the dishwasher refers to the normal level of washing liquid in the dishwasher during normal operation of the circulation pump. However, periods, preferably shorter, of higher washing liquid levels, where washing liquid is allowed to flow into the soil trap, could be acceptable.

For control of the level of soil and washing liquid, valves can be arranged at the sump and at the outlet of the soil trap. The valves are open during drainage and closed during circulation or any other non-drainage situations during the dishwashing. The valves can alternatively be replaced by a drain pump, which is then turned on and off correspondingly to the opened and closed valves. The valves can be individually controlled. Alternatively, only one of the valves is replaced by the drain pump.

The soil trap can further comprise a return flow inhibitor to prevent reflow of soil out of the soil trap and back into the circulation flow. The return flow inhibitor can for example be a hopper or funnel shaped trap device, downwards directed flanges, a screening sheet or a valve.

The filter of the present invention can be a net, a fabric or a grating, but as the filter of the present invention is cleaned frequently, it can also, preferably, be a fine-mesh filter. In a dishwasher according to the prior art, the flow is divided to flow through a fine-mesh filter and a coarse-mesh filter, as described above in the background art section. By filtering the circulation flow only through a fine-mesh filter, and frequently or regularly remove the soil caught at the filter to prevent clogging of the filter, the recirculated washing liquid is more completely cleaned. Thus, the cleaning efficiency of the filter and the operation reliability of the dishwasher according to the invention is improved.

The filter surface comprises a filter edge which can be arranged in connection to the inlet of the soil trap, whereby soil can be transferred by the transport unit from the filter surface and tip over the edge into the soil trap. The surface of the filter can also be inclined sloping downward away from the inlet of the soil trap, such that the filter edge proximal to the soil trap is raised relative the distal end to let the edge of the filter be above the washing liquid level as described above. Alternatively the surface of the filter can be plane or be inclined such that the distal end of the filter is raised relative the edge proximal to the soil trap.

The filter can be located completely or partly under the washing liquid level of the dishwasher. It is also possible to have the circulation flow passing through the filter above the washing liquid level of the dishwasher.

The filter can be one integral unit or comprise several subfilters. The shape of the filter can be circular, triangular, rectangular, or combinations thereof. The surface of the filter can be flat or curved. The filter can be built up by several subfilters into the shape of for example a truncated pyramid or cone.

The soil trap can be arranged in the centre of the sump or at one edge. The soil trap can be surrounded by filter surfaces, or the soil trap can be arranged to one side of the filter. The soil trap can be extended along the filter edge and/or centred between two filter surfaces.

DETAILED DESCRIPTION OF THE PREFERRED EMBODIMENTS OF THE INVENTION

Figure 1:
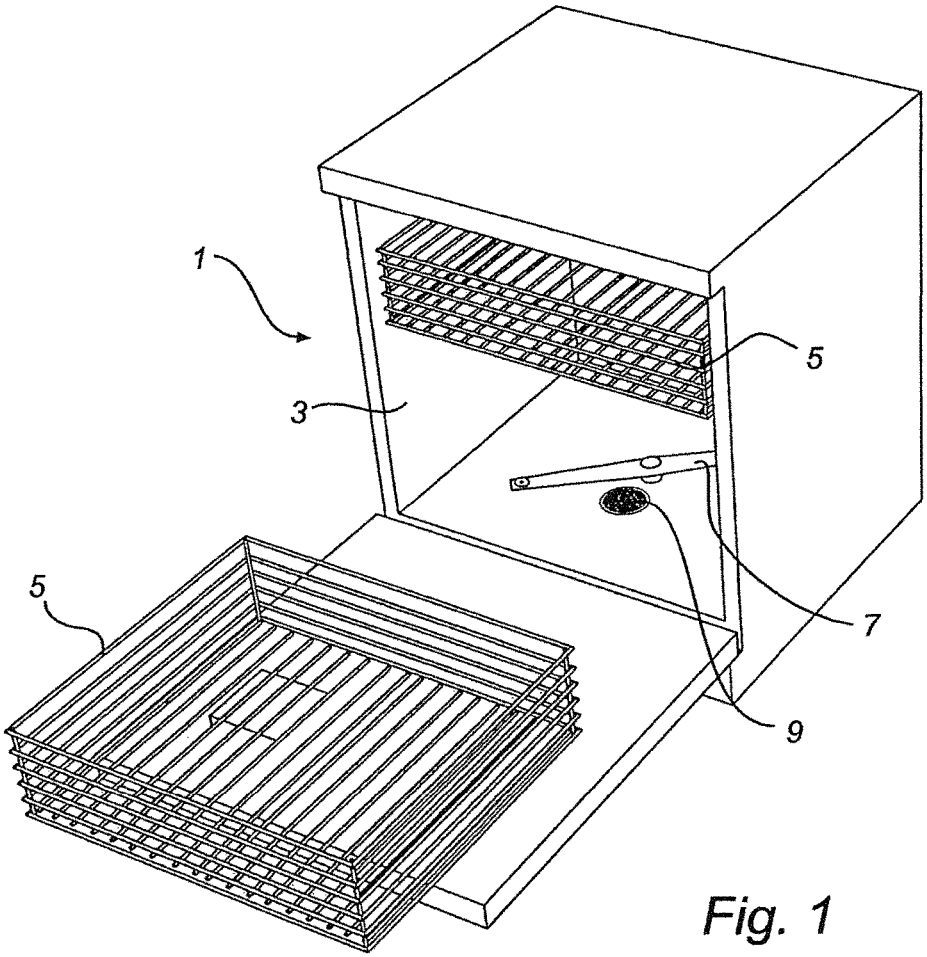
FIG. 1 is a perspective view of a dishwasher according to a preferred embodiment of the invention.

FIG. 1 is a schematic perspective view of an embodiment of a dishwasher 1 according to the invention. The dishwasher 1 includes a washing chamber 3, baskets 5 to hold soiled items to be washed, a spray arm 7 and a glass trap 9 arranged above a sump 17.

Figure 2:
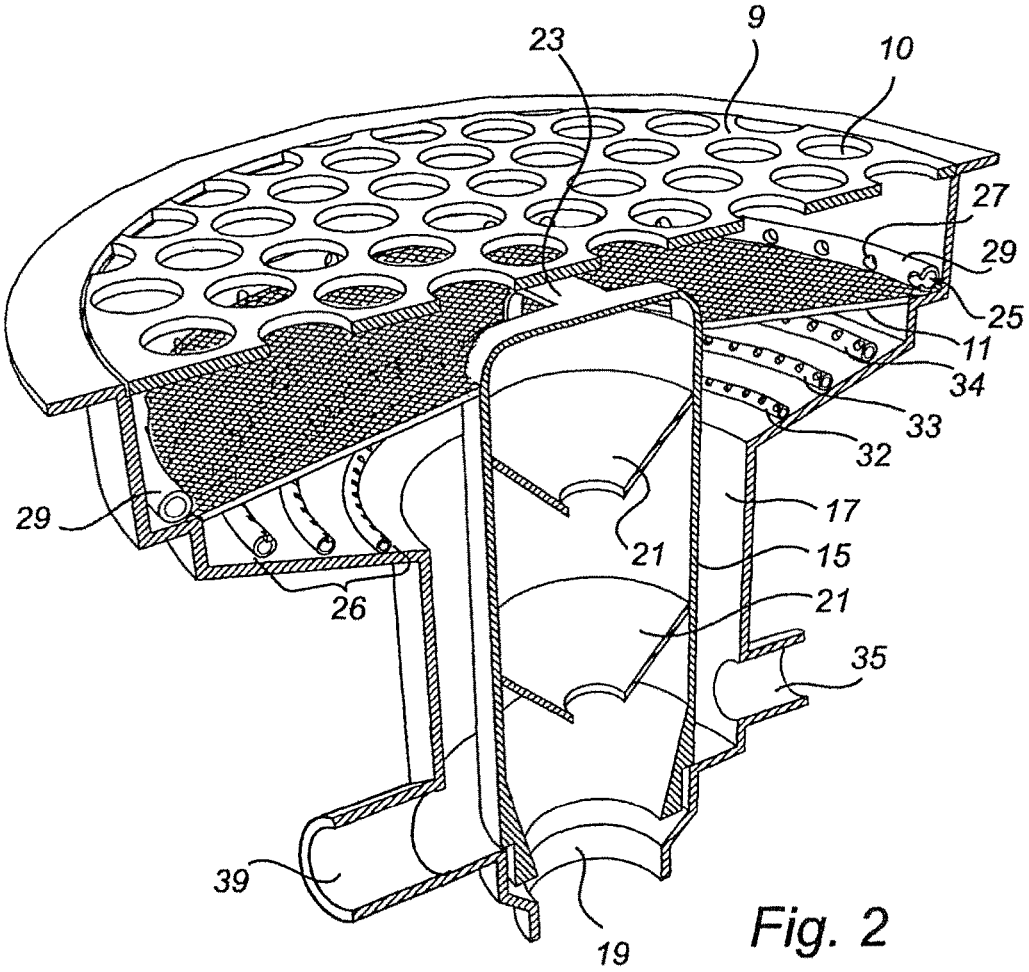
FIG. 2 is a sectional perspective view of a part of a dishwasher according to an embodiment of the invention.

FIG. 2 is a sectional perspective view of a part of a dishwasher 1 according to an embodiment of the invention, showing a glass trap 9, a filter 11, a soil trap 15 and a sump 17. The glass trap 9 is a very coarse filter, in this example a plane surface covered with regularly distributed circular holes 10. Underneath the glass trap 9 there is arranged a fine-mesh filter 11. The filter 11 has the shape of a truncated cone with its centre part raised relatively its periphery part. In the centre of the filter 11, the soil trap 15 is located. The filter comprises a filter surface having a filter edge and the inlet of the soil trap is arranged abutting against the filter edge.

Figure 4:
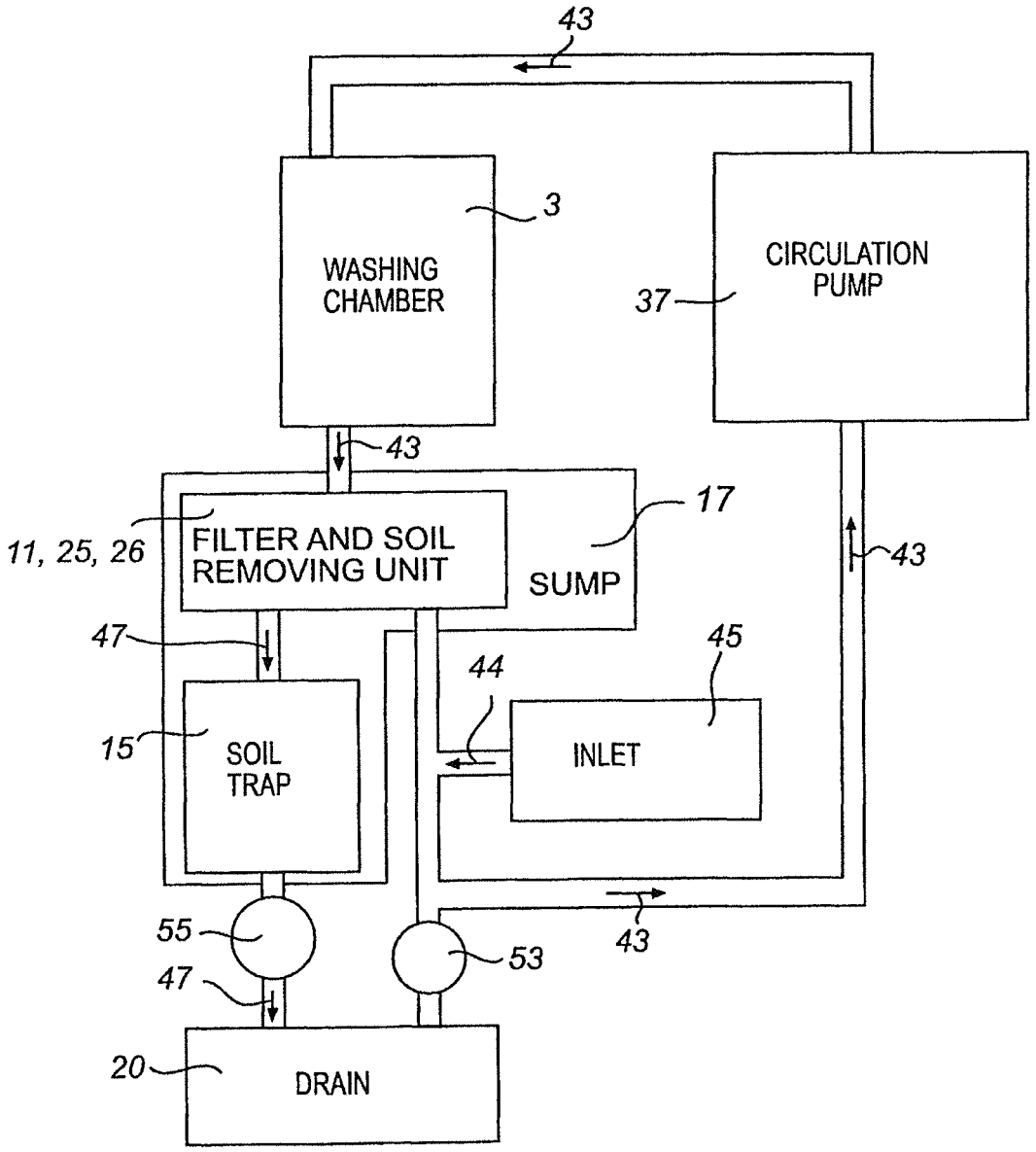
FIG. 4 is a schematic diagram of flows according to an embodiment of the invention.

The soil trap 15 is a liquid-tight cylinder with its upper end at the level of the filter surface and its lower end 19 connected to a drain 20, c.f. FIG. 4. The soil trap 15 is on its inner cylinder surface provided with two return flow inhibitors 21 in the form of hopper-shaped trap devices. On the upper end of the soil trap 15, there is provided a handle 23 for gripping the soil trap 15 at removal, in case of a desired cleaning.

The dishwasher further comprises a soil removing unit comprising a transport unit 25 and a filter cleaning unit 26. The transport unit 25 is in this embodiment nozzles 27 for water jets arranged in a tube 29, which is attached at the periphery of the filter 11. The nozzles 27 are directed parallel to the surface of the filter 11 towards the soil trap 15. The tube 29 with the nozzles 27 is connected to a water source (alternatively to the circulation flow). The nozzles can alternatively be provided in the wall at the periphery of the filter.

The filter cleaning unit 26 is arranged to clean the filter 11 from soil 31 that is stuck or adhered to the surface of the filter 11. The filter cleaning unit 26 shown in FIG. 2 and FIG. 3 comprises three perforated tubes 32, 33, 34 arranged as rings of three different diameters underneath the filter. The tubes 32, 33, 34 are provided with air outlets to provide bubbles through the filter 11. The tubes 32, 33, 34 are connected to an air source (not shown).

The sump 17 is arranged underneath the glass trap 9 and is surrounding the cylinder shaped soil trap 15. At the lower part of the sump 17 there is provided two outlets, one circulation outlet 35 connected to the circulation pump 37 and one drain outlet 39 connected to the drain 20. The drain outlet 39 is arranged at the bottom level of the sump 17 to assure that the dishwasher can be completely drained.

Figure 3:
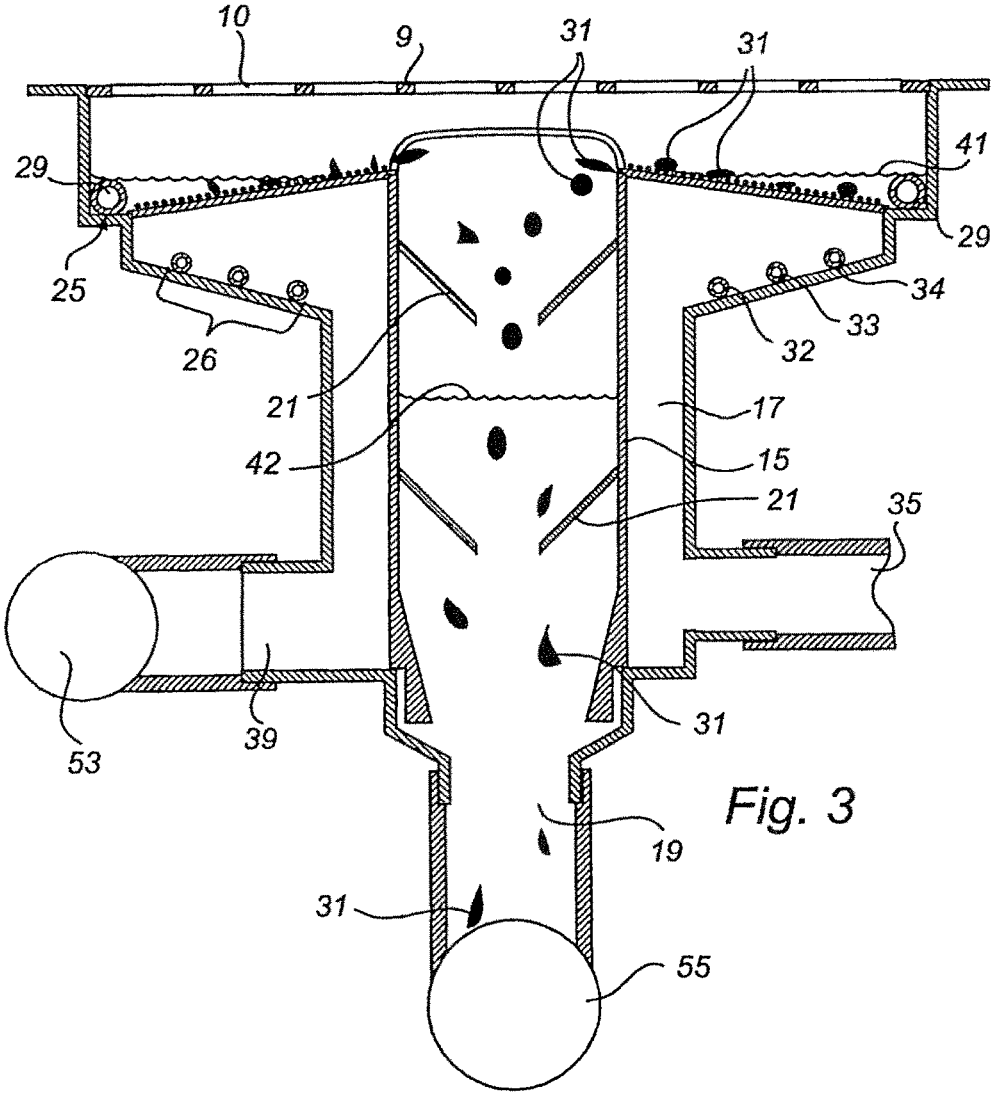
FIG. 3 is a sectional view of the part of FIG. 2, additionally showing the level of washing liquid and soil.

An example of the operation of an embodiment of a dishwasher will now be described with reference to FIG. 1, FIG. 2, FIG. 3 and FIG. 4. FIG. 3 is a sectional view of the dishwasher 1 as shown in FIG. 2, further showing the liquid levels 41, 42 and soil particles 31.

As a start, the user places soiled items to be washed in the baskets 5 of the dishwasher 1, closes the front and starts the dishwasher.

The components of the washing liquid, water and dishwasher detergents, enters to the sump 9 with an inlet flow 44 through an inlet 45. The dishwasher is, to a predetermined level, filled up with the washing liquid. Thereafter the circulation pump 37 creates a circulation flow 43 of the washing liquid through the washing chamber 3 via the spray arm 7, pass the soiled items, into the sump 17, through the filter 11 and back to the washing chamber 3.

During circulation in the dishwasher 1, the items placed in the washing chamber 3 are cleaned by the flow 43 of washing liquid. The flow 43 of washing liquid passes through the washing chamber 3 and soil 31 is released from the items to be washed and caught in the flow 43. The glass trap 9 at the bottom of the washing chamber 3 protects the circulation pump 37 from larger particles like tooth picks or pieces of broken glass. When the flow 43 of washing liquid with soil 31 passes through the filter 11, after having passed the glass trap 9, soil 31 is caught at the filter 11 and separated from the flow 43 of washing liquid.

Regularly during the circulation, at predetermined intervals, the soil removing unit 25, 26 releases soil 31 from the filter 11 and transports the soil 31 into the soil trap 15. Just before a transporting water flush by the transport unit 25, the filter cleaning unit 26 flushes air, generating bubbles, which bubbles transfers up through the filter 11 in a direction which is opposite to the direction of the circulation flow and releases stuck and adhered soil 31 from the filter 11. This is partly due to vibrations imparted to the filter by the passing bubbles. The amount of generated bubbles and the length of the time periods at which they are released, is adapted such that the circulation flow maintains a flow rate which is acceptable for the cleaning operation.

Subsequently, the nozzles 27 of the transport unit 25 flushes water during a limited period of time, whereby soil 31 is transferred from the filter 11, over the filter surface, over the filter edge and falls by gravity into the soil trap 15.

The soil trap 15 is located separate from the circulation flow 43, and is arranged to collect soil 31 and keep the soil 31 separate from the circulation flow 43. The soil trap 15 is provided with return flow inhibitors 21, in the shape of hopper shaped trap devices, which counteracts a reflow of soil 31 back into the circulation flow 43.

In this embodiment, the major part of the filter surface is located under the washing liquid level 41 in the sump 17 of the dishwasher. Consequently, the nozzles 27 are arranged to push the soil over the filter surface across a simultaneous circulation flow through the filter surface.

For control of the washing liquid level 41 in the and the liquid level 42 in the soil trap 15, one valve 53 is arranged at the drain outlet 39 of the sump 17 and one valve 55 is arranged at the bottom of the soil trap 15. If the liquid level 42 in the soil trap 15 reaches a predetermined highest level, soil 31 and washing liquid is drained from the soil trap 15 by opening of the valve 55. The soil 31 and the washing liquid in the soil trap 15 is then drained in a soil flow 47.

The valves 53, 55 can alternatively be replaced by a drain pump, which is then turned on and off correspondingly to the opened and closed valves 53, 55. Alternatively, only one of the valves 53, 55 are replaced by a drain pump.

The circulation flow 43 that has entered the sump 17 and passed the filter 11, then recirculates by the circulation pump 37 back into the washing chamber 3.

When the washing operation is finished, the sump 17 and the soil trap 15 are drained through the drain 20, by opening of the valves 53, 55 (or alternatively by turning the drain pump on).

Finally the user opens the front of the dishwasher and removes the items from the baskets, which items now are cleaned from soil.

Figure 5:
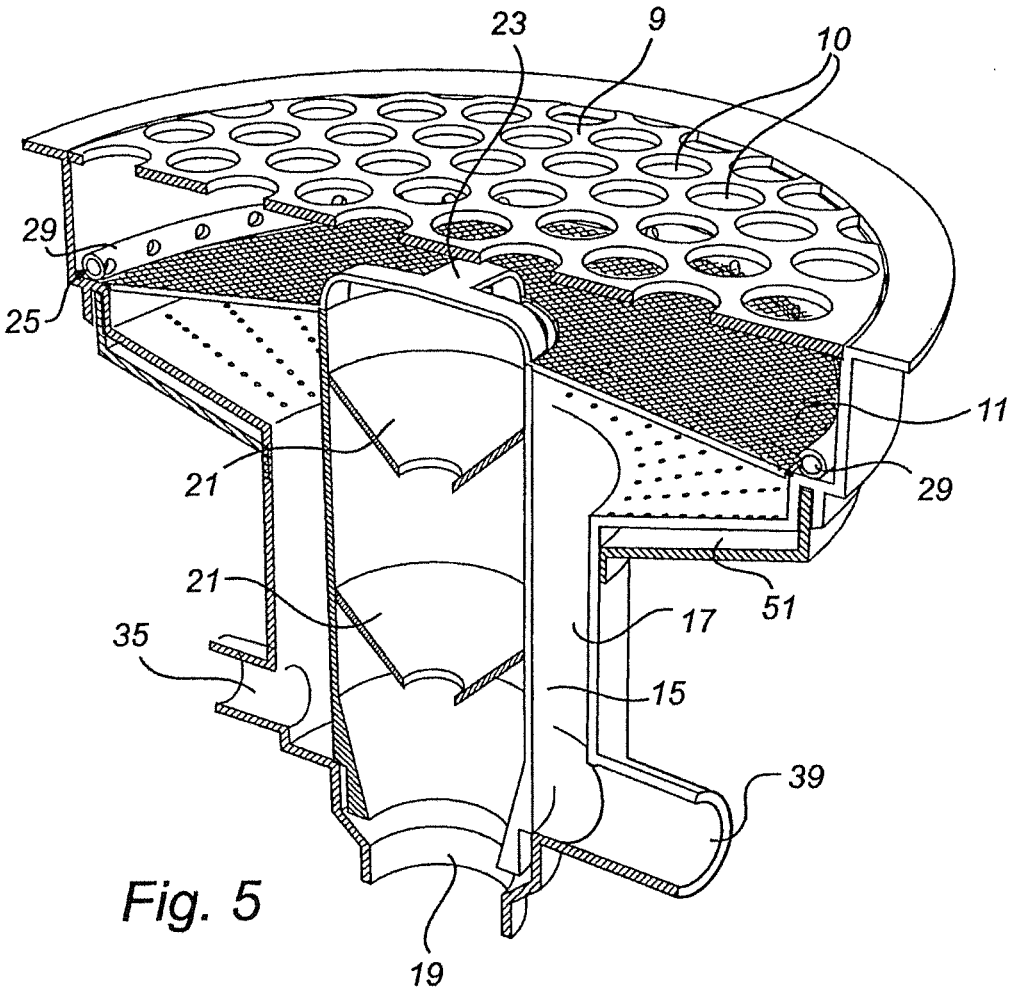
FIG. 5 is a sectional perspective view of a part of a dishwasher according to an alternative embodiment of the invention.
Figure 6:
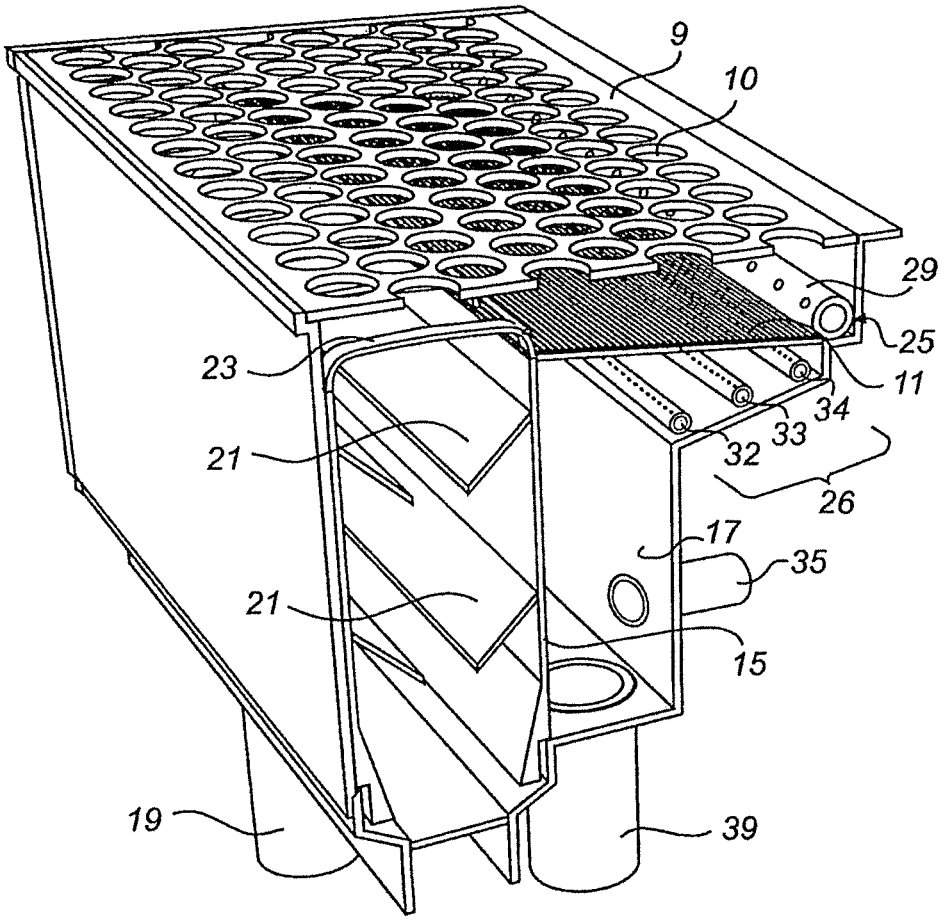
FIG. 6 is a sectional perspective view of a part of a dishwasher according to another alternative embodiment of the invention.

Alternative embodiments of the invention are shown in FIG. 5 and FIG. 6. Only the divergence from the previously shown embodiment will be described here.

In FIG. 5 the tubes 32, 33, 34 of the filter cleaning unit 26 in FIG. 2 and FIG. 3 has been replaced by a perforated hollow ring-shaped plate 51. The perforations are nozzles, directed towards the under side of the filter. Just as for the tubes 32, 33, 34, this plate can be connected to the source of fluid for filter cleaning, which can be air or gas (which can result in bubbles), recycled washing liquid, fresh water, etc.

In FIG. 6 the shapes of the glass trap 9, the filter 11, the extension of the tubes 29, 32, 33, 34, the sump 17, the soil trap 15 and the return flow inhibitors 21 are altered from circular to rectangular. The glass trap 9 and the fine-mesh filter 11 are of a flat, rectangular shape. The fine-mesh filter 11 is inclined with its raised edge adjacent to the inlet of the soil trap 15. The soil trap 15 is a container with a rectangular through-cut. The sump 17 is located at on one side of the soil trap 15. The tubes 29, 32, 33, 34 are extended in one direction instead of, as the previously described, circular rings. The return flow inhibitors 21 are in the shape of flanges directed downwards. The function is as described with reference to the circular design, described with reference to FIG. 1-4.

Although described with reference to a preferred embodiment of the present invention, it should be readily apparent to one of ordinary skill in the art that various changes and/or modifications can be made without departing from the scope of the invention as set forth in the accompanying claims. In general, the invention is only intended to be limited to the following claims.

The invention claimed is:

1. A method of operating a dishwasher, the dishwasher comprising a washing chamber arranged for holding soiled items to be washed, a filter comprising a filter surface, a circulation pump connected to a sump of the dishwasher downstream of the filter, a soil trap disposed separate from a circulation flow, wherein an inlet of the soil trap is defined adjacent an edge of the filter surface, a soil removing unit comprising a filter cleaning unit and a transport unit, wherein the filter cleaning unit comprises a plurality of outlets disposed beneath the filter and downstream of the filter, wherein the transport unit comprises a plurality of nozzles arranged adjacent the filter surface, and wherein the plurality of nozzles are oriented parallel to the filter surface towards the inlet of the soil trap, the method comprising:

filling the sump with a washing liquid to a washing liquid level, wherein the washing liquid level extends at least to a portion of the filter;

circulating washing liquid into the washing chamber with the circulation pump to generate the circulation flow wherein the washing chamber is configured such that, when the circulation flow of washing liquid passes through the washing chamber, soil is released from the items to be washed and caught in the circulation flow, and wherein the filter is such arranged that, when the circulation flow of washing liquid with soil passes through the filter, soil is separated from the circulation flow of washing liquid and caught at the filter;

releasing bubbles into the washing liquid with the filter cleaning unit, such that the bubbles move in the washing liquid through the filter in a direction opposite a direction of the circulation flow to release the soil from the filter maintaining the washing liquid level at least while the bubbles are released into the washing liquid during a washing cycle; and transporting soil released by the filter cleaning unit adjacent the filter surface and into the soil trap with the transport unit.

2. The method according to claim 1, wherein the filter surface slopes downwardly and outwardly away from the inlet of the soil trap.

3. The method according to claim 1, wherein transporting soil released by the filter cleaning unit adjacent the filter surface and into the soil trap comprises flushing a fluid parallel to the filter surface for transport of the soil in the fluid into the soil trap.

4. The method according to claim 1, wherein the soil trap comprises a return flow inhibitor to prevent reflow of soil out of the soil trap and back into the circulation flow.

5. The method according to claim 4, wherein the return flow inhibitor is a hopper-shaped trap device.

6. The method according to claim 4, wherein the return flow inhibitor comprises at least one angled surface attached to a wall of the soil trap and projecting into an interior of the soil trap.

7. The method according to claim 1, wherein the soil trap is connected to a drain pump.

8. The method according to claim 7, wherein maintaining the washing liquid level at least partially comprises activating the drain pump.

9. The method according to claim 1, wherein the dishwasher comprises a valve arranged at a drain outlet of the sump and a valve arranged at the soil trap, and wherein maintaining the washing liquid level comprises opening at least one of the valve arranged at a drain outlet of the sump and the valve arranged at the soil trap.

10. The method according to claim 1, wherein the filter has the shape of a truncated cone and the inlet of the soil trap is a liquid-tight open cylinder located at the center of the filter.

11. The method according to claim 1, wherein releasing bubbles into the washing liquid with the filter cleaning unit comprises continuously releasing bubbles during the washing cycle.

12. The method according to claim 1, wherein releasing bubbles into the washing liquid with the filter cleaning unit comprises pulsing the bubbles during the washing cycle.

13. The method according to claim 1, wherein releasing bubbles into the washing liquid with the filter cleaning unit comprises releasing the bubbles in response to detecting filter clogging with a sensor.

14. The method according to claim 1, wherein the plurality of outlets of the filter cleaning unit are disposed circumferentially around the soil trap directly beneath the filter.

15. The method according to claim 1, wherein the filter surface includes a radial periphery and an opening defined by the edge, wherein the soil trap defines a liquid-tight container configured to receive soil, wherein the inlet of the soil trap is at the opening proximate a top of the filter, and wherein the plurality of nozzles of the transport unit are arranged at the radial periphery of the filter surface.

16. The method according to claim 1, wherein the filter cleaning unit is activated to release the bubbles into the washing liquid before the transport unit is activated to transport soil released by the filter cleaning unit adjacent the filter surface and into the soil trap.

17. The method according to claim 1, wherein releasing bubbles into the washing liquid with the filter cleaning unit comprises releasing bubbles at predetermined intervals.

18. The method according to claim 1, wherein releasing bubbles into the washing liquid with the filter cleaning unit occurs in response to detecting a pressure build up due to filter clogging.

19. The method according to claim 5, wherein the soil trap defines a cylindrical wall comprising a first end and a second end, and wherein the hopper-shaped trap device is attached to the cylindrical wall and projects into an interior of the soil trap from the cylindrical wall between the first end and second end.

20. A method of operating a dishwasher, the dishwasher comprising a washing chamber, a sump, and a filter comprising a filter surface, the method comprising:

filling the sump of the dishwasher with a washing liquid to a washing liquid level, wherein the washing liquid level extends at least to a portion of the filter;

circulating washing liquid into the washing chamber with a circulation pump to generate a circulation flow, wherein the washing chamber is configured such that, when a the circulation flow of washing liquid passes through the washing chamber, soil is released from items to be washed and caught in the circulation flow, and wherein the filter is such arranged that, when the circulation flow of washing liquid with soil passes through the filter, soil is separated from the circulation flow of washing liquid and caught at the filter;

releasing bubbles into the washing liquid, such that the bubbles move in the washing liquid through the filter in a direction opposite a direction of the circulation flow to release the soil from the filter;

maintaining the washing liquid level at least while the bubbles are released into the washing liquid during a washing cycle; and transporting soil released by the bubbles adjacent the filter surface and into a soil trap with a transport unit.

21. The method according to claim 20, wherein releasing bubbles includes releasing bubbles from a plurality of outlets of a filter cleaning unit disposed beneath the filter in the washing liquid.

22. The method according to claim 21, wherein the plurality of outlets of the filter cleaning unit are disposed circumferentially around the soil trap directly beneath the filter.

23. The method according to claim 20, wherein transporting soil released by the bubbles adjacent the filter surface and into the soil trap comprises flushing a fluid parallel to the filter surface for transport of the soil in the fluid into the soil trap.

24. The method according to claim 20, wherein the dishwasher comprises a valve arranged at a drain outlet of the sump and a valve arranged at the soil trap, and wherein maintaining the washing liquid level comprises opening at least one of the valve arranged at a drain outlet of the sump and the valve arranged at the soil trap.

25. The method according to claim 20, wherein the bubbles are released into the washing liquid before the transport unit is activated to transport soil released by the bubbles adjacent the filter surface and into the soil trap.

* * * * *